US010138912B2

(12) United States Patent
Tsai et al.

(10) Patent No.: US 10,138,912 B2
(45) Date of Patent: Nov. 27, 2018

(54) HIGH OUTPUT HYDRAULIC CYLINDER AND PISTON ARRANGEMENT

(71) Applicant: EATON INTELLIGENT POWER LIMITED, Dublin (IE)

(72) Inventors: Chang-Chun Tsai, Ann Arbor, MI (US); Sandeep Manohar Birje, Ivishalashts (IN); Peter Megens, DD Eindhoven (NL)

(73) Assignee: Eaton Intelligent Power Limited (IE)

( * ) Notice: Subject to any disclaimer, the term of this patent is extended or adjusted under 35 U.S.C. 154(b) by 195 days.

(21) Appl. No.: 15/034,563

(22) PCT Filed: Nov. 5, 2014

(86) PCT No.: PCT/US2014/064174
§ 371 (c)(1),
(2) Date: May 5, 2016

(87) PCT Pub. No.: WO2015/069801
PCT Pub. Date: May 14, 2015

(65) Prior Publication Data

US 2016/0273556 A1 Sep. 22, 2016

(30) Foreign Application Priority Data

Nov. 5, 2013 (IN) ..... 1260/KOL/2013

(51) Int. Cl.
*F15B 15/02* (2006.01)
*F15B 15/14* (2006.01)

(52) U.S. Cl.
CPC ..... *F15B 15/02* (2013.01); *F15B 15/1404* (2013.01); *F15B 15/1447* (2013.01)

(58) Field of Classification Search
CPC ... F15B 15/02; F15B 15/1404; F15B 15/1447
See application file for complete search history.

(56) References Cited

U.S. PATENT DOCUMENTS 4,412,476 A * 11/1983 Benaroya ..... F02B 71/06 92/75
4,726,283 A * 2/1988 Miyamoto ..... F15B 11/0365 29/888.044

(Continued)

FOREIGN PATENT DOCUMENTS

JP 04-277304 A 10/1992
JP 11-013710 A 1/1999
JP 11013710 A * 1/1999

OTHER PUBLICATIONS

International Search Report for corresponding International Patent Application No. PCT/US2014/064174 dated Feb. 17, 2015.

*Primary Examiner* — Thomas E Lazo
(74) *Attorney, Agent, or Firm* — Merchant & Gould P.C.

(57) ABSTRACT

Reciprocally moving an output rod mounted to a force transfer member includes applying hydraulic pressure to a first piston and cylinder device to operate the first piston and cylinder device in compression to move the force transfer member in a first direction; applying hydraulic pressure to a second piston and cylinder device to operate the second piston and cylinder device in compression to move the force transfer member in an opposite second direction; refraining from applying tension to the second piston and cylinder device while applying hydraulic pressure to the first piston and cylinder device; and refraining from applying tension to the first piston and cylinder device while applying hydraulic pressure to the second piston and cylinder device.

27 Claims, 3 Drawing Sheets

(56) References Cited

U.S. PATENT DOCUMENTS

| | | | | |
|---|---|---|---|---|
| 5,154,586 | A * | 10/1992 | Rudick | B67D 1/0036 417/415 |
| 5,351,603 | A * | 10/1994 | Yuda | B23Q 37/00 92/128 |
| 7,469,625 | B2 | 12/2008 | Nassif | |
| 7,556,480 | B2 * | 7/2009 | Eilertsen | F04B 9/02 417/415 |
| 8,677,799 | B2 | 3/2014 | Jamet | |
| 2010/0186583 | A1 | 7/2010 | Loga et al. | |
| 2013/0031896 | A1 | 2/2013 | Kelly | |

* cited by examiner

HIGH OUTPUT HYDRAULIC CYLINDER AND PISTON ARRANGEMENT

CROSS-REFERENCE TO RELATED APPLICATION(S)

This application is a National Stage of PCT/US2014/064174 filed on Nov. 5, 2014 which claims priority to Indian Patent Application Serial No. 1260/KOL/2013 filed on Nov. 5, 2013 and which applications are incorporated herein by reference. To the extent appropriate, a claim of priority is made to each of the above disclosed applications.

TECHNICAL FIELD

The present disclosure relates generally to piston and cylinder arrangements.

BACKGROUND

Hydraulic piston and cylinder arrangements are used for mechanical actuation in many applications. A typical hydraulic piston and cylinder arrangement includes a piston that mounts within a cylinder body. The piston typically includes a piston rod connected to a piston head. Pressurized hydraulic fluid is directed into and out of the cylinder body, thereby causing the piston rod to extend and retract relative to the cylinder body. Improved performance is desirable particularly in the area of high output piston and cylinder assemblies.

SUMMARY

The present disclosure relates generally to a piston and cylinder assembly having piston and cylinder devices configured to operate solely in compression. In certain examples, a piston and cylinder assembly is configured to transfer relatively high forces to an output rod that is configured to be coupled to a piece of machinery or equipment (e.g., a compressor). In certain examples, the output rod can include a main shaft and at least one end flange that is unitary with the main shaft. In certain examples, the end flange can be coupled to an output component (e.g., a piece of machinery or equipment, or an adapter or fitting suitable for providing a connection with a piece of equipment or machinery) by a plurality of threaded fasteners (e.g., bolts). Each fastener is torqued sufficiently to have a desired pre-load level suitable for preventing fatigue. In certain examples, the piston and cylinder arrangement can include multiple paired piston and cylinder devices that transfer forces to an output rod through an intermediate force transfer structure that is coupled to all the piston and cylinder devices of the piston and cylinder arrangement.

Another aspect of the present disclosure relates to piston and cylinder arrangements that eliminate the need for relatively large, threaded joints. The elimination of such large, threaded joints is advantageous because such large, threaded joints can fatigue when subject to repeated tension and compression cycles if not provided with the proper amount of pre-load. This can be problematic because of the difficulty associated with applying the proper pre-load to such large, threaded joints.

Another aspect of the present disclosure relates to a high output linear actuator having an output capacity that exceeds 15 million newtons. In certain examples, the linear actuator has an output rod that is free of any relatively large threaded joints that can be difficult to pre-load. Instead, the output rod includes a main shaft and a unitary end flange. The end flange can include a plurality of fastener openers for receiving a plurality of threaded fasteners (e.g., bolts) that can be used to couple the output rod to another structure. In certain examples, the threaded fasteners have diameters that are substantially smaller than the outer diameter of the main shaft. In certain examples, the threaded fasteners are sized so as to be easily installed with a desired amount of pre-load.

Another aspect of the present disclosure relates to a method of reciprocally moving an output rod mounted to a force transfer member of a hydraulic piston and cylinder arrangement. The method includes applying hydraulic pressure to a first piston and cylinder device to operate the first piston and cylinder device in compression to move the force transfer member in a first direction; applying hydraulic pressure to a second piston and cylinder device to operate the second piston and cylinder device in compression to move the force transfer member in an opposite second direction; refraining from applying tension to the second piston and cylinder device while applying hydraulic pressure to the first piston and cylinder device; and refraining from applying tension to the first piston and cylinder device while applying hydraulic pressure to the second piston and cylinder device.

In certain implementations, an output component is coupled to the output rod by threading a plurality of fasteners through apertures defined in an end flange of the output rod.

Another aspect of the present disclosure relates to a hydraulic piston and cylinder arrangement including a force transfer member; an output rod coupled to the force transfer member to move with the force transfer member; a first piston and cylinder device coupled to the force transfer member; and a second piston and cylinder device coupled to the force transfer member. The first and second piston and cylinder devices are configured to be operated only in compression. The first piston and cylinder device is configured to move the force transfer member in a first direction when the first piston and cylinder device is operated in compression, thereby moving the output rod in the first direction. The second piston and cylinder device is configured to move the force transfer member in a second direction when the second piston and cylinder device is operated in compression, thereby moving the output rod in the second direction.

A variety of additional aspects will be set forth in the description that follows. The aspects relate to individual features and to combinations of features. It is to be understood that both the forgoing general description and the following detailed description are explanatory only and are not restrictive of the broad inventive aspects upon which the examples disclosed herein are based.

DETAILED DESCRIPTION

Figure 1:
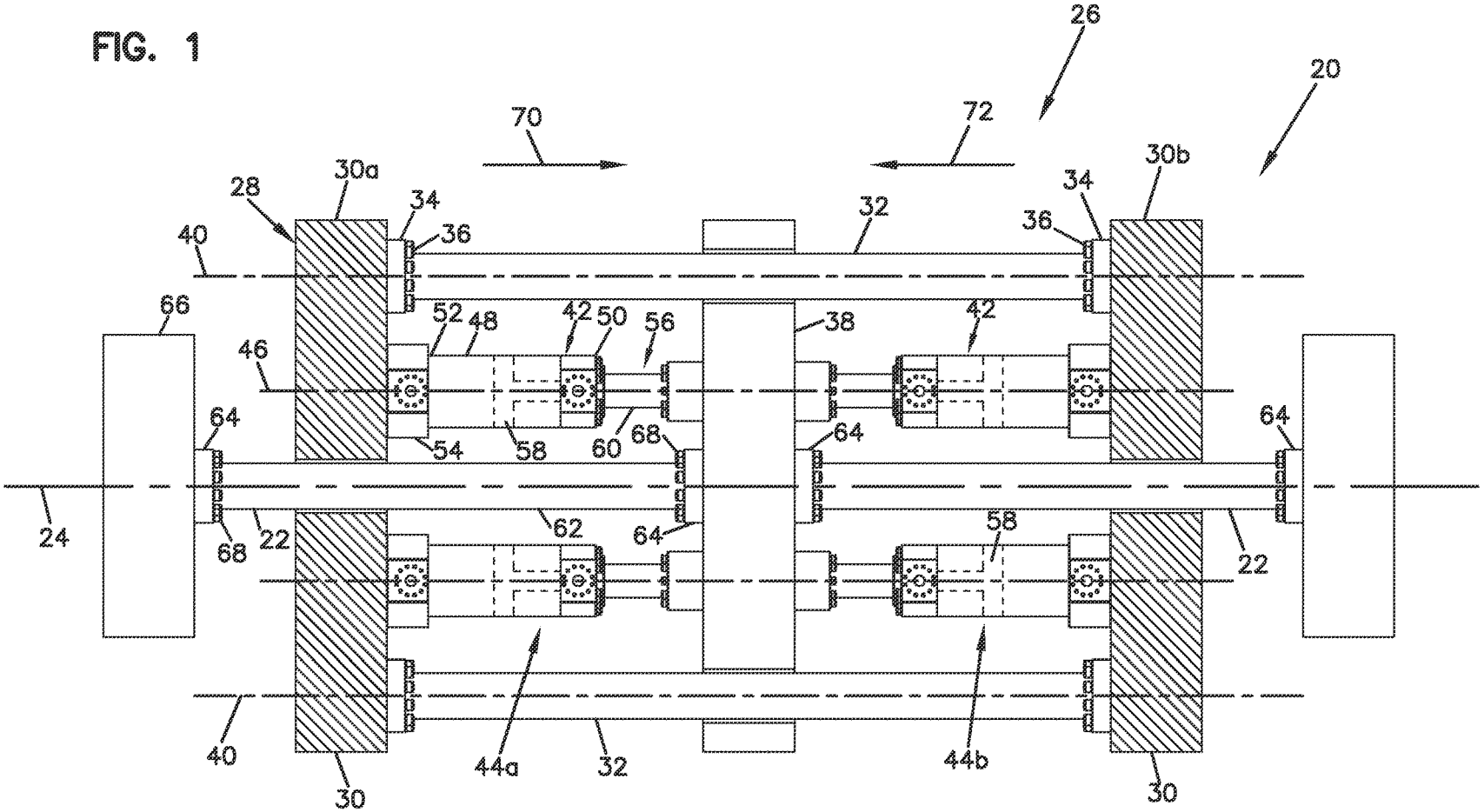
FIG. 1 shows a first example high output linear actuator in accordance with the principles of the present disclosure.

A hydraulic piston and cylinder arrangement including a force transfer member; an output rod coupled to the force transfer member to move with the force transfer member; a first piston and cylinder device coupled to the force transfer member; and a second piston and cylinder device coupled to the force transfer member. The first and second piston and cylinder devices are configured to be operated only in compression. The first piston and cylinder device is configured to move the force transfer member in a first direction when the first piston and cylinder device is operated in compression, thereby moving the output rod in the first direction. The second piston and cylinder device is configured to move the force transfer member in a second direction when the second piston and cylinder device is operated in compression, thereby moving the output rod in the second direction.

Each piston and cylinder device includes a piston reciprocally movable through a rod end of a cylinder body. In certain implementations, each piston and cylinder device is configured to receive hydraulic pressure at only a cap end of the respective cylinder body and not at the rod end of the respective cylinder body.

In certain implementations, the cap ends of the cylinder bodies are mounted to a frame so that the force transfer member is configured to move relative to the frame. In an example, the frame includes two spaced apart frame members coupled together by cross-members along which the force transfer member is configured to slide when moved in the first and second directions. In another example, the force transfer member includes two spaced apart flanges that are coupled together by cross-members and between which the frame is disposed.

In use, the output rod is reciprocally moved by applying hydraulic pressure to the first piston and cylinder device to operate the first piston and cylinder device in compression to move the force transfer member in a first direction, thereby moving the output rod in the first direction; and refraining from applying tension to the second piston and cylinder device while applying hydraulic pressure to the first piston and cylinder device. Hydraulic pressure is then applied to the second piston and cylinder device to operate the second piston and cylinder device in compression to move the force transfer member in an opposite second direction; and tension is not applied to the first piston and cylinder device while hydraulic pressure is applied to the second piston and cylinder device.

In certain implementations, multiple first piston and cylinder devices are coupled to a first side of the force transfer member and multiple second piston and cylinder devices are mounted to a second side of the force transfer member. The first piston and cylinder devices are configured to move the force transfer member in the first direction when the first piston and cylinder devices are operated in compression. The second piston and cylinder devices are configured to move the force transfer member in the second direction when the second piston and cylinder devices are operated in compression. In an example, the first side of the force transfer member faces away from the second side of the force transfer member. In another example, the first side of the force transfer member faces towards the second side of the force transfer member.

In certain implementations, an output component is coupled to the output rod by threading fasteners through apertures defined in an end of the output rod. In an example, the output rod includes a main shaft and at least one end flange that is unitary with the main shaft. The end flange defines fastener openings through which the threaded fasteners are inserted to couple the end flange to an output component. In certain examples, the main shaft of the output rod includes a second end flange that is unitary with the main shaft at an opposite end of the main shaft from the end flange. In an example, the second end flange is configured to couple to the force transfer member using threaded fasteners.

In certain implementations, a second output rod is coupled to the force transfer member to move with the force transfer member. In an example, the second output rod is coupled to an opposite side of the force transfer member than the output rod. In an example, the second output rod extends coaxially with the output rod in an opposite direction to the output rod. Another output component can be coupled to the second output rod by threading fasteners through apertures defined in an end (e.g., a unitary end flange) of the second output rod.

Referring now to the drawings, FIG. 1 illustrates an example high output linear actuator 20 in accordance with the principles of the present disclosure. The linear actuator 20 includes two output rods 22 that are reciprocated back and forth along an axis 24 by a piston and cylinder arrangement 26. The piston and cylinder arrangement 26 includes a frame 28 having spaced-apart frame members 30 through which the output rods 22 extend and relative to which the output rods 22 are moveable along the axis 24. The frame members 30 are coupled together by coupling rods 32 that extend between the frame members 30. In an example, the coupling rods 32 are parallel to one another. The coupling rods 32 can include integral flanges 34 fastened to the frame members 30 by a plurality of threaded fasteners 36 (e.g., bolts).

The piston and cylinder arrangement 26 also includes a force transfer member 38 that is mounted to slide on the coupling rods 32. The coupling rods 32 are aligned along axes 40 that are parallel to the axis 24. The piston and cylinder arrangement 26 further includes a plurality of piston and cylinder devices 42 configured to move the force transfer member 38 along the axis 24. A first set 44*a* of the piston and cylinder devices 42 is mounted between a first 30*a* of the frame members 30 and the force transfer member 38. A second set 44*b* of the piston and cylinder devices 42 is mounted between a second 30*b* of the frame members 30 and the force transfer member 38. The piston and cylinder devices 42 are aligned along axes 46 that are parallel to the axis 24.

Still referring to FIG. 1, the piston and cylinder devices 42 are configured for moving the force transfer member 38 back and forth along the axis 24 between the first and second frame members 30*a*, 30*b*. The piston and cylinder devices 42 each include a cylinder body 48 having a rod end 50 and a cap end 52. Each of the piston and cylinder devices 42 also includes a cap 54 mounted at the cap end 52 of the cylinder body 48 and a piston 56 that slides relative to the cylinder body 48 along the axis 46. The piston 56 includes a piston head 58 captured within the cylinder body 48 and a piston rod 60 that projects outwardly from the rod end 50 of the cylinder body 48.

As depicted at FIG. 1, the cylinder bodies 48 of the first set 44*a* of piston and cylinder devices 42 are coupled to the first frame member 30*a* and the outer ends of the piston rods 60 of the piston and cylinder devices 42 of the first set 44*a* are coupled to the force transfer member 38. The cylinder bodies 48 of the second set 44*b* of piston and cylinder devices 42 are coupled to the second frame member 30*b* and the outer ends of the piston rods 60 of the piston and cylinder devices 42 of the second set 44*b* are coupled to the force transfer member 38.

The output rods 22 of the linear actuator 20 each include a main shaft 62 and end flanges 64 that are unitarily formed with the main shaft 62. The end flanges 64 at outer ends of the output rods 62 are fastened to components 66 (e.g., equipment, machinery, or fittings or adapters suitable for providing an intermediate interface between the end flanges 64 and the equipment or machinery) by threaded fasteners 68, such as bolts. The threaded fasteners 68 can extend through openings defined in the end flanges 64 and can be threaded into the components 66. The surface area provided by the end flanges 64 is sufficiently large to provide a sufficient number of threaded fasteners 68 to securely attach the components 66 to the output rods 22. The threaded fasteners 68 are sufficiently small so as to be able to be installed at a precise pre-loading level. The end flanges 64 at inner ends of the output rods 22 are attached to the force transfer member 38 in a similar manner.

The first set 44*a* of piston and cylinder devices 42 is configured to drive the force transfer member 38 and thus the output rods 22 in a first direction 70 along the axis 24. The second set 44*b* of piston and cylinder devices 42 is configured to drive the force transfer member 38 and thus the output rods 22 in a second direction 72 along the axis 24. The first and second directions 70, 72 are opposite with respect to one another. The piston and cylinder devices 42 are configured to act through a common element or structure in the form of the force transfer member 38 when actuated. Thus, the force transfer member 38 functions to transfer force from one or more of the piston and cylinder devices 42 to the output rods 22.

The piston and cylinder devices 42 are configured to only operate in compression. For example, hydraulic pressure (e.g., pressurized hydraulic fluid) is only provided to the cap ends 52 of the cylinder bodies 48 and is not provided to the rod ends 50 of the cylinder bodies 48. In certain examples, the rod ends 50 of the cylinder bodies 48 can be ported to atmosphere through a structure such as a breather valve. Thus, in such examples, air is provided within the cylinder body 48 in the region between the piston head 58 and the rod end 50 of the cylinder body 48. In other examples, fluid communication can be provided across or through the piston head 58 such that movement of the piston 56 relative to the cylinder body 48 causes hydraulic fluid within the cylinder body 48 to flow from one side of the piston head 58 to an opposite side of the piston head.

In use of the linear actuator 20, the first and second sets 44*a*, 44*b* of piston and cylinder devices 42 are alternatingly actuated/pressurized to drive the output rods 22 back and forth along the axis 24. The first set 44*a* of piston and cylinder devices 42 are actuated by providing hydraulic pressure to the cap ends 52 of the cylinder bodies 48, thereby causing the pistons 56 to move in the first direction 70 relative to the cylinder bodies 48 movement of the pistons 56 in the first direction 70 causes the force transfer member 38 and thus the output rods 22 attached thereto to move in the first direction 70 along the axis 24.

As the output rods 22 move in the first direction 70, hydraulic pressure is not provided to the rod ends 50 of the cylinder bodies 48 of the second set 44*b* of piston and cylinder devices 42. Instead, the pistons 56 of the piston and cylinder devices 42 of the second set 44*b* move passively along the first direction 70 within their corresponding cylinder bodies 48 as a result of the force applied to the force transfer member 38 by the piston and cylinder devices 42 of the first set 44*a*. Thus, the piston and cylinder devices 42 of the second set 44*b* do not apply force to the force transfer member 38 to actively pull the force transfer member 38 in the first direction 70. In other words, the piston and cylinder devices 42 of the second set 44*b* are not operated in tension as the force transfer member 38 and the corresponding output rods 22 are moved in the first direction 70.

Once the force transfer member 38 and the corresponding output rods 22 have been moved in the first direction 70 by the first set 44*a* of piston and cylinder devices 42, hydraulic pressure is disconnected from the cap ends 52 of the cylinder bodies 48 of the piston and cylinder devices 42 of the first set 44*a*. Hydraulic pressure is connected and applied to the cap ends 52 of the cylinder bodies 48 of the piston and cylinder devices 42 of the second set 44*b*. This application of hydraulic pressure causes the piston and cylinder devices 42 of the second set 44*b* to push the force transfer member 38 and the corresponding output rods 22 in the second direction 72. Thus, the piston and cylinder devices 42 of the second set 44*b* are caused to operate in compression.

When hydraulic pressure is applied to the rod ends 50 of the cylinder bodies 48 of the piston and cylinder devices 42 of the second set 44*b*, hydraulic pressure is not provided to the rod ends 50 of the cylinder bodies 48 of the piston and cylinder devices 42 of the first set 44*a*. Instead, the pistons 56 of the first set 44*a* are passively moved within their corresponding cylinder bodies 48 via force derived from the second set 44*b*. The piston and cylinder devices 42 of the first set 44*a* do not operate in tension and do not apply a force to the force transfer member 38 for moving the force transfer member in the second direction 72. It will be appreciated that the first and second sets 44*a*, 44*b* are alternatingly actuated to reciprocate the output rods 22 back and forth along the axis 24.

Figure 2:
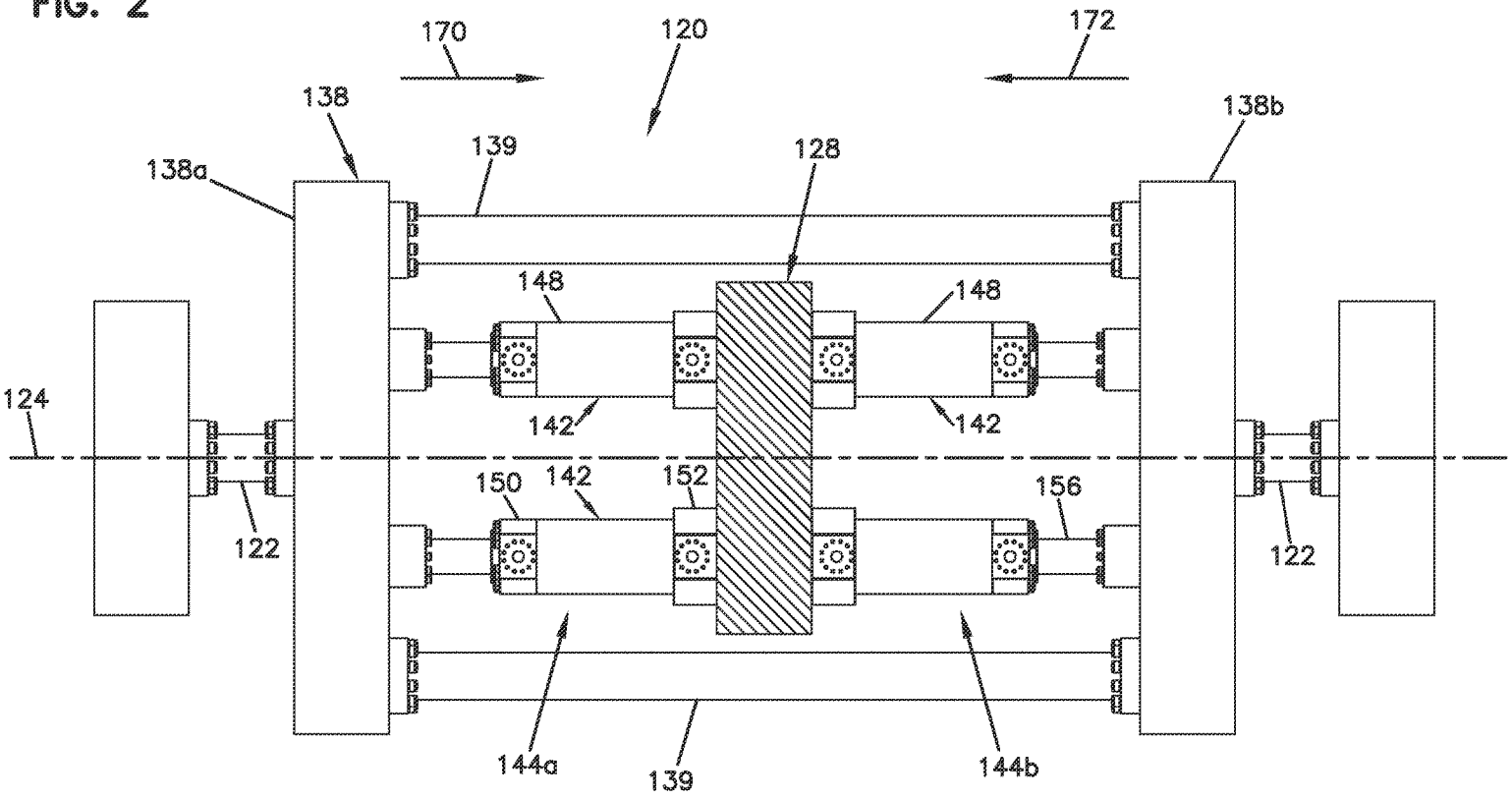
FIG. 2 illustrates a second example high output linear actuator in accordance with the principles of the present disclosure.

FIG. 2 shows another example linear actuator 120 in accordance with the principles of the present disclosure. The linear actuator 120 has a fixed central frame 128. The linear actuator 120 also includes first and second sets 144*a*, 144*b* of piston and cylinder devices 142 of the type previously described. Each piston and cylinder devices 142 has a rod end 150 and a cap end 152. The first and second sets 144*a*, 144*b* of piston and cylinder devices 142 are coupled between the fixed central frame 128 and a force transfer member 138. In certain implementations, the first and second sets 144*a*, 144*b* are mounted on opposite sides of the central frame 128. For example, the cap ends 152 of the piston and cylinder devices 142 can be mounted to the central frame 128.

The force transfer member 138 is coupled to output rods 122 that are aligned along an axis 124. The force transfer member 138 is configured to move along the axis 124. In certain examples, the force transfer member 138 includes one or more rods 139 or other cross-members extending between spaced-apart flanges 138*a*, 138*b*. In certain examples, the central frame 128 and the first and second sets 144*a*, 144*b* of piston and cylinder devices 142 are disposed between the flanges 138*a*, 138*b*. In an example, the cylinder bodies 148 of the first set 144*a* of piston and cylinder devices 142 are coupled to one side of the central frame 128 and the outer ends of the piston rods of the piston and cylinder devices 142 of the first set 144*a* are coupled to a first flange 138*a* of the force transfer member 138. The cylinder bodies 148 of the second set 144*b* of piston and cylinder devices 142 are coupled to another side of the central frame 128 and the outer ends of the piston rods of the piston and cylinder devices 142 of the second set 144*b* are coupled to a second flange 138*b* of the force transfer member 138.

In use, the first and second sets 144*a*, 144*b* of piston and cylinder devices 142 cooperate with the force transfer member 138 to linearly reciprocate the output rods 122 back and forth along the axis 124. Similar to the previously described embodiments, it is desirable for none of the piston and cylinder devices 142 to operate in tension. Instead, the first and second sets 144*a*, 144*b* of piston and cylinder devices 142 are alternatingly actuated in compression to generate compression strokes that move the force transfer member 138 back and forth along the axis 124. For example, when the first set 144*a* of piston and cylinder devices 142 is operated in compression, the force transfer member 138 is moved in a first direction 170 along the axis 124, thereby causing the output rods 122 to move in the first direction 170. In contrast, when the second set 144*b* of piston and cylinder devices 142 is actuated in compression, the force transfer member 138 is driven in a second direction 172 along the axis 124, thereby moving the output rods 122 in the second direction 172.

Figure 3:
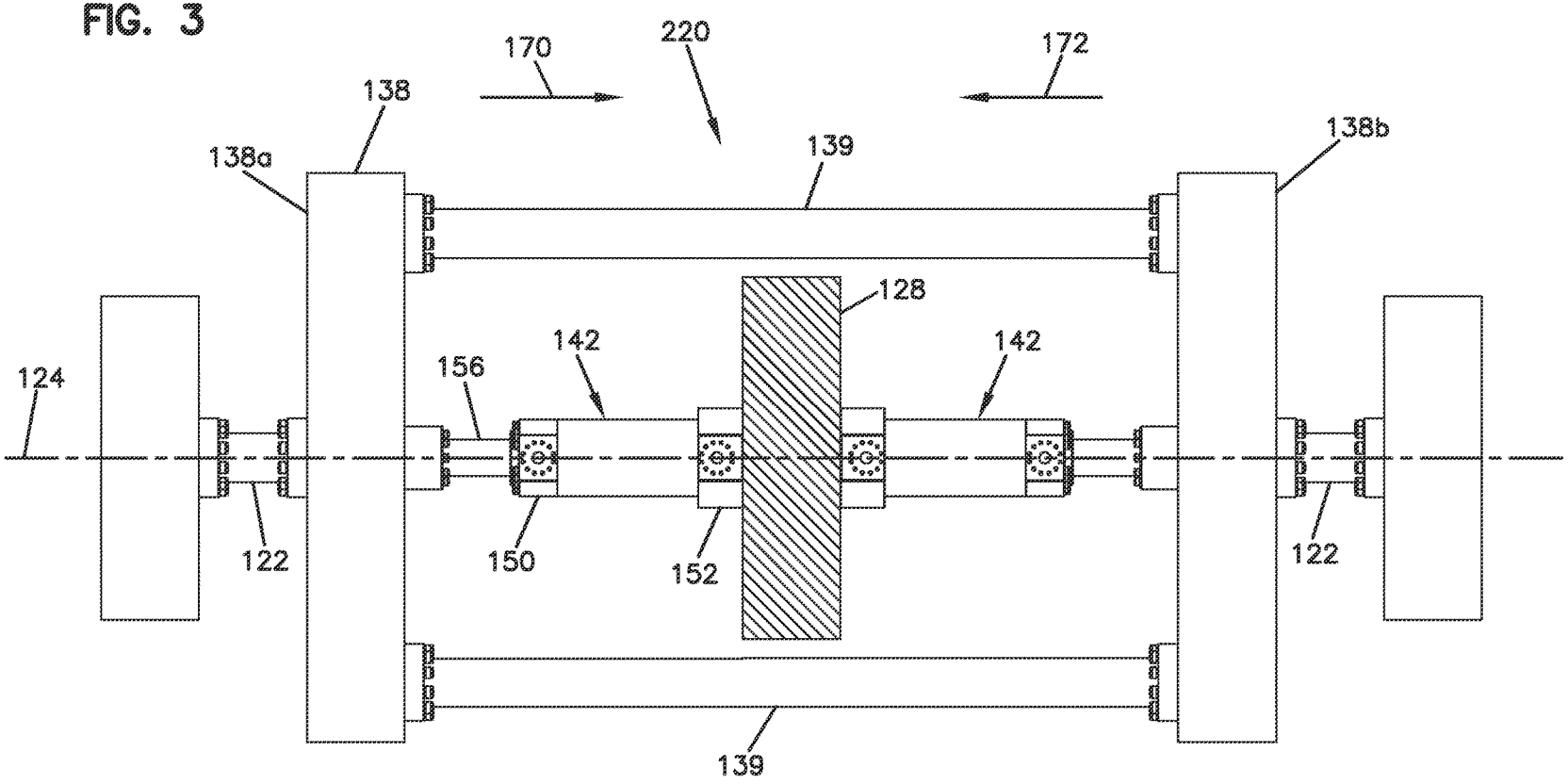
FIG. 3 illustrates a third example high output linear actuator in accordance with the principles of the present disclosure.

FIG. 3 shows another example linear actuator 220 in accordance with the principles of the present disclosure. The linear actuator 220 has the same general configuration as the linear actuator 120 shown in FIG. 2, except that only one piston and cylinder device 142 is provided on each side of the fixed central frame 128. A cap end 152 of each piston and cylinder device 142 is coupled to the central frame 128. A piston 156 of each piston and cylinder device 142 is coupled to one of the flanges 138*a*, 138*b* of the force transfer member 138.

In use, when the piston and cylinder device 142 on a first side of the central frame 128 is operated in compression, the force transfer member 138 is moved in a first direction 170 along the axis 124, thereby causing the output rods 122 to move in the first direction 170. In contrast, when the piston and cylinder device 142 on the second side of the central frame 128 is actuated in compression, the force transfer member 138 is driven in a second direction 172 along the axis 124, thereby moving the output rods 122 in the second direction 172.

In certain implementations, no hydraulic pressure is applied to the rod end 150 of the piston and cylinder devices 142.

In certain implementations, no hydraulic fluid is applied to the piston and cylinder device 142 on a second side of the frame 128 when the piston and cylinder device 142 on the first side of the central frame 128 is operated. No hydraulic fluid is applied to the piston and cylinder device 142 on the first side of the frame 128 when the piston and cylinder device 142 on the second side of the central frame 128 is operated.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A method of reciprocally moving an output rod coupled to a force transfer member of a hydraulic piston and cylinder arrangement, the method comprising:

coupling an output component to the output rod by threading a plurality of fasteners through apertures defined in an end flange of the output rod;

applying hydraulic pressure to a first piston and cylinder device to operate the first piston and cylinder device in compression to move the force transfer member in a first direction;

applying hydraulic pressure to a second piston and cylinder device to operate the second piston and cylinder device in compression to move the force transfer member in an opposite second direction;

refraining from applying tension to the second piston and cylinder device while applying hydraulic pressure to the first piston and cylinder device; and refraining from applying tension to the first piston and cylinder device while applying hydraulic pressure to the second piston and cylinder device.

2. The method as claimed in claim 1, wherein applying hydraulic pressure to each piston and cylinder device comprises applying hydraulic pressure to only a first end of the piston and cylinder device and refraining from applying hydraulic pressure to an opposite second end of the piston and cylinder device.

3. The method as claimed in claim 1, further comprising sliding the output rod along a first axis as the force transfer member is moved in the first and second directions, the first axis being parallel to longitudinal axes of the first and second piston and cylinder devices.

4. The method as claimed in claim 3, wherein the force transfer member is slid along portions of a frame as the force transfer member is moved in the first and second directions, wherein the output rod extends outwardly from the frame.

5. A hydraulic piston and cylinder arrangement comprising:

a force transfer member;

a first output rod coupled to a first side of the force transfer member to move with the force transfer member;

a second output rod coupled to a second side of the force transfer member to move with the force transfer member, the second side being opposite the first side;

a first piston and cylinder device coupled to the force transfer member, the first piston and cylinder device being configured to be operated only in compression, and the first piston and cylinder device being configured to move the force transfer member in a first direction when the first piston and cylinder device is operated in compression, wherein the first and second output rods move with the force transfer member; and a second piston and cylinder device coupled to the force transfer member, the second piston and cylinder device being configured to be operated only in compression, and the second piston and cylinder device being configured to move the force transfer member in an opposite second direction when the second piston and cylinder device is operated in compression, wherein the first and second output rods move with the force transfer member.

6. The hydraulic piston and cylinder arrangement as claimed in claim 5, wherein the first output rod includes a main shaft and at least one end flange that is unitary with the main shaft, the end flange defining a plurality of fastener openings configured to receive a plurality of threaded fasteners to couple the end flange to an output component.

7. The hydraulic piston and cylinder arrangement as claimed in claim 6, wherein the main shaft includes a second end flange that is unitary with the main shaft at an opposite end of the main shaft from the end flange, the second end flange being configured to couple to the force transfer member.

8. The hydraulic piston and cylinder arrangement as claimed in claim 5, wherein the first piston and cylinder device is part of a first set of piston and cylinder devices coupled to the force transfer member and configured to move the force transfer member in the first direction when the piston and cylinder devices of the first set are operated in compression; and wherein the second piston and cylinder device is part of a second set of piston and cylinder devices coupled to the force transfer member and configured to move the force transfer member in the second direction when the piston and cylinder devices of the second set are operated in compression.

9. The hydraulic piston and cylinder arrangement as claimed in claim 5, wherein the first piston and cylinder device includes a first cylinder body and a first piston, wherein the first piston mounts to a first side of the force transfer member; and wherein the second piston and cylinder device includes a second cylinder body and a second piston, wherein the second piston mounts to a second side of the force transfer member.

10. The hydraulic piston and cylinder arrangement as claimed in claim 9, wherein the first side of the force transfer member faces away from the second side of the force transfer member.

11. The hydraulic piston and cylinder arrangement as claimed in claim 9, wherein the first side of the force transfer member faces towards the second side of the force transfer member.

12. The hydraulic piston and cylinder arrangement as claimed in claim 9, wherein each piston and cylinder device is configured to receive hydraulic pressure at only a cap end of the respective cylinder body.

13. The hydraulic piston and cylinder arrangement as claimed in claim 9, further comprising a frame to which cap ends of the first and second cylinder bodies are coupled, wherein the force transfer member is configured to move relative to the frame.

14. The hydraulic piston and cylinder arrangement as claimed in claim 13, wherein the frame includes two spaced apart frame members coupled together by cross-members, wherein the force transfer member is disposed between the frame members and configured to slide along at least one of the cross-members, wherein the first piston and cylinder device is disposed between the force transfer member and a first of the frame members, and wherein the second piston and cylinder device is disposed between the force transfer member and a second of the frame members.

15. The hydraulic piston and cylinder arrangement as claimed in claim 14, wherein the first piston and cylinder device is part of a first set of piston and cylinder devices coupled to the force transfer member and the first frame member, the first set of piston and cylinder devices being configured to move the force transfer member in the first direction relative to the frame when the piston and cylinder devices of the first set are operated in compression; and wherein the second piston and cylinder device is part of a second set of piston and cylinder devices coupled to the force transfer member and to the second frame member, the second set of piston and cylinder devices being configured to move the force transfer member in the second direction relative to the frame when the piston and cylinder devices of the second set are operated in compression.

16. The hydraulic piston and cylinder arrangement as claimed in claim 13, wherein the force transfer member includes two spaced apart flanges coupled together by cross-members, wherein the frame is disposed between the flanges of the force transfer member, wherein the first piston and cylinder device is disposed between the frame and a first of the flanges of the force transfer member, and wherein the second piston and cylinder device is disposed between the frame and a second of the flanges of the force transfer member.

17. The hydraulic piston and cylinder arrangement as claimed in claim 16, wherein the first piston and cylinder device is part of a first set of piston and cylinder devices coupled to the frame and the first flange of the force transfer member, the first set of piston and cylinder devices being configured to move the force transfer member in the first direction relative to the frame when the piston and cylinder devices of the first set are operated in compression; and wherein the second piston and cylinder device is part of a second set of piston and cylinder devices coupled to the frame and the second flange of the force transfer member, the second set of piston and cylinder devices being configured to move the force transfer member in the second direction relative to the frame when the piston and cylinder devices of the second set are operated in compression.

18. The hydraulic piston and cylinder arrangement as claimed in claim 5, wherein the first and second piston and cylinder devices are aligned along an axis extending parallel to a slide axis along which the first output rod moves with the force transfer member.

19. The hydraulic piston and cylinder arrangement as claimed in claim 5, wherein the second output rod extending coaxially with the first output rod in an opposite direction to the first output rod.

20. A method of reciprocally moving an output rod coupled to a force transfer member of a hydraulic piston and cylinder arrangement, the method comprising:

applying hydraulic pressure to a first piston and cylinder device to operate the first piston and cylinder device in compression to move the force transfer member in a first direction;

applying hydraulic pressure to a second piston and cylinder device to operate the second piston and cylinder device in compression to move the force transfer member in an opposite second direction;

refraining from applying tension to the second piston and cylinder device while applying hydraulic pressure to the first piston and cylinder device; and refraining from applying tension to the first piston and cylinder device while applying hydraulic pressure to the second piston and cylinder device;

sliding the output rod along a first axis as the force transfer member is moved in the first and second directions, the first axis being parallel to longitudinal axes of the first and second piston and cylinder devices, wherein the force transfer member is slid along portions of a frame as the force transfer member is moved in the first and second directions, wherein the output rod extends outwardly from the frame.

21. A hydraulic piston and cylinder arrangement comprising:

a force transfer member;

an output rod coupled to the force transfer member to move with the force transfer member, the output rod including a main shaft and at least one end flange that is unitary with the main shaft, the end flange defining a plurality of fastener openings configured to receive a plurality of threaded fasteners to couple the end flange to an output component;

a first piston and cylinder device coupled to the force transfer member, the first piston and cylinder device being configured to be operated only in compression, and the first piston and cylinder device being configured to move the force transfer member in a first direction when the first piston and cylinder device is operated in compression, wherein the output rod moves with the force transfer member; and a second piston and cylinder device coupled to the force transfer member, the second piston and cylinder device being configured to be operated only in compression, and the second piston and cylinder device being configured to move the force transfer member in an opposite second direction when the second piston and cylinder device is operated in compression, wherein the output rod moves with the force transfer member.

22. The hydraulic piston and cylinder arrangement as claimed in claim 21, wherein the main shaft includes a second end flange that is unitary with the main shaft at an opposite end of the main shaft from the end flange, the second end flange being configured to couple to the force transfer member.

23. A hydraulic piston and cylinder arrangement comprising:

a force transfer member;

an output rod coupled to the force transfer member to move with the force transfer member;

a first piston and cylinder device coupled to the force transfer member, the first piston and cylinder device including a first cylinder body and a first piston, wherein the first piston mounts to a first side of the force transfer member, the first piston and cylinder device being configured to be operated only in compression, and the first piston and cylinder device being configured to move the force transfer member in a first direction when the first piston and cylinder device is operated in compression, wherein the output rod moves with the force transfer member; and a second piston and cylinder device coupled to the force transfer member, the second piston and cylinder device including a second cylinder body and a second piston, wherein the second piston mounts to a second side of the force transfer member, wherein the first side of the force transfer member faces away from the second side of the force transfer member, the second piston and cylinder device being configured to be operated only in compression, and the second piston and cylinder device being configured to move the force transfer member in an opposite second direction when the second piston and cylinder device is operated in compression, wherein the output rod moves with the force transfer member.

24. A hydraulic piston and cylinder arrangement comprising:

a force transfer member;

an output rod coupled to the force transfer member to move with the force transfer member;

a first piston and cylinder device coupled to the force transfer member, the first piston and cylinder device including a first cylinder body and a first piston, wherein the first piston mounts to a first side of the force transfer member, the first piston and cylinder device being configured to be operated only in compression, and the first piston and cylinder device being configured to move the force transfer member in a first direction when the first piston and cylinder device is operated in compression, wherein the output rod moves with the force transfer member; and a second piston and cylinder device coupled to the force transfer member, the second piston and cylinder device including a second cylinder body and a second piston, wherein the second piston mounts to a second side of the force transfer member, the second piston and cylinder device being configured to be operated only in compression, and the second piston and cylinder device being configured to move the force transfer member in an opposite second direction when the second piston and cylinder device is operated in compression, wherein the output rod moves with the force transfer member;

a frame to which cap ends of the first and second cylinder bodies are coupled, wherein the force transfer member is configured to move relative to the frame, the frame including two spaced apart frame members coupled together by cross-members, wherein the force transfer member is disposed between the frame members and configured to slide along at least one of the cross-members, wherein the first piston and cylinder device is disposed between the force transfer member and a first of the frame members, and wherein the second piston and cylinder device is disposed between the force transfer member and a second of the frame members.

25. The hydraulic piston and cylinder arrangement as claimed in claim 24, wherein the first piston and cylinder device is part of a first set of piston and cylinder devices coupled to the force transfer member and the first frame member, the first set of piston and cylinder devices being configured to move the force transfer member in the first direction relative to the frame when the piston and cylinder devices of the first set are operated in compression; and wherein the second piston and cylinder device is part of a second set of piston and cylinder devices coupled to the force transfer member and to the second frame member, the second set of piston and cylinder devices being configured to move the force transfer member in the second direction relative to the frame when the piston and cylinder devices of the second set are operated in compression.

26. A hydraulic piston and cylinder arrangement comprising:

a force transfer member including two spaced apart flanges coupled together by cross-members;

an output rod coupled to the force transfer member to move with the force transfer member;

a first piston and cylinder device coupled to the force transfer member, the first piston and cylinder device including a first cylinder body and a first piston, wherein the first piston mounts to a first side of the force transfer member, the first piston and cylinder device being configured to be operated only in compression, and the first piston and cylinder device being configured to move the force transfer member in a first direction when the first piston and cylinder device is operated in compression, wherein the output rod moves with the force transfer member; and a second piston and cylinder device coupled to the force transfer member, the second piston and cylinder device including a second cylinder body and a second piston, wherein the second piston mounts to a second side of the force transfer member, the second piston and cylinder device being configured to be operated only in compression, and the second piston and cylinder device being configured to move the force transfer member in an opposite second direction when the second piston and cylinder device is operated in compression, wherein the output rod moves with the force transfer member;

a frame to which cap ends of the first and second cylinder bodies are coupled, wherein the force transfer member is configured to move relative to the frame, the frame being disposed between the flanges of the force transfer member, wherein the first piston and cylinder device is disposed between the frame and a first of the flanges of the force transfer member, and wherein the second piston and cylinder device is disposed between the frame and a second of the flanges of the force transfer member.

27. The hydraulic piston and cylinder arrangement as claimed in claim 26, wherein the first piston and cylinder device is part of a first set of piston and cylinder devices coupled to the frame and the first flange of the force transfer member, the first set of piston and cylinder devices being configured to move the force transfer member in the first direction relative to the frame when the piston and cylinder devices of the first set are operated in compression; and wherein the second piston and cylinder device is part of a second set of piston and cylinder devices coupled to the frame and the second flange of the force transfer member, the second set of piston and cylinder devices being configured to move the force transfer member in the second direction relative to the frame when the piston and cylinder devices of the second set are operated in compression.

* * * * *